United States Patent [19]

McComas

[11] Patent Number: 4,868,982

[45] Date of Patent: Sep. 26, 1989

[54] DISPOSABLE RAZOR USING PISTON MOVEMENT FOR DISPENSING SHAVING MATERIALS

[76] Inventor: James L. McComas, 15180 Fern, Boulder Creek, Calif. 95006

[21] Appl. No.: 182,132

[22] Filed: Apr. 15, 1988

[51] Int. Cl.[4] ..... B26B 21/44

[52] U.S. Cl. ..... 30/41; 30/86; 30/90

[58] Field of Search ..... 30/41, 86, 87, 90; 220/541

[56] References Cited

U.S. PATENT DOCUMENTS

| | | | |
|---|---|---|---|
| 2,131,498 | 9/1938 | Chandler | 30/41 |
| 2,392,975 | 1/1946 | Cooney | 30/41 |
| 2,866,265 | 12/1958 | Kells | 30/41 |
| 3,985,146 | 10/1976 | Albach | 30/41 |
| 4,562,643 | 1/1986 | Cataudella | 30/41 |

FOREIGN PATENT DOCUMENTS

| | | | |
|---|---|---|---|
| 653595 | 1/1986 | Switzerland | 30/41 |

*Primary Examiner*—Frank T. Yost
*Assistant Examiner*—Yu C. Lin
*Attorney, Agent, or Firm*—The Dulin Law Firm

[57] ABSTRACT

An all in one disposable razor assembly comprising a hollow-shafted handle having a blade-attached razor head at a first end and an opening at a second, opposite end of the handle. The handle includes a central cavity therein with an elongated cavity lip disposed outside adjacent the open end of the hollow handle to receive a reservoir of stabilized shaving material in an amount sufficient for a single use. The cavity has disposed therein a dispensing assembly comprising a piston head and an attached towing cable for manually forcing the shaving material out of the hollow handle through the open end. In the preferred embodiment, the dispensing assembly includes a cap, initially attached to the elongated lip but easily releasable therefrom by pulling on an attached tear-away tab. Dispensing the shaving material is performed by releasing the cap and pulling the towing cable out of the cavity thereby moving the piston head from the blade-attached end to the open end, forcing the shaving material from the cavity into the user's hand. The cap is preferably attached by heat wherein the outer circumference of the cap is thermally back-welded to the underside of the cavity lip. An alternate embodiment provides for a reusable razor and shaving assembly wherein individual refill cartridges, each of which contains the above mentioned dispensing assembly and shaving material, may be repetitively inserted in the cavity of the handle.

7 Claims, 1 Drawing Sheet

DISPOSABLE RAZOR USING PISTON MOVEMENT FOR DISPENSING SHAVING MATERIALS

FIELD

The present invention relates to shaving systems in general, and more particularly to a disposable razor having a manually operated piston dispenser integrally positioned within the razor, for easy expelling of stabilized shaving materials such as shaving creams, lathers, foams or gels from the razor.

In accordance with present invention, the handle of the disposable razor is hollow to define a central cavity forming an reservoir for the stabilized shaving material. The hollow cavity is sealed by means of a tear-away cap. Applying sufficient leverage to the cap exposes the head of the shaving material to atmospheric pressure. Subsequent movement of the cap away from the handle pulls a piston head through the cavity so as sweep the shaving material before the moving head and thence into the user's hand. The system is handy for travel as (a) only the correct amount of premeasured shaving material accompanies the razor for a single-use application and unnecessary excess is kept to a minimum, and (b) two key parts of the system (razor and shaving material) are combined as a unit so that they cannot be overlooked during packing.

DEFINITIONS

In this Application, the term "stabilized shaving material" means a dispersion of soap, builders and air containing sufficient channeling to permit equalization of air pressure as piston heads are pulled through the handle of the razor. Air can pass either over or through the shaving material and thence behind the piston head into the volume previously occupied by the head. In one aspect, when the cavity is quasi-filled with shaving creams or lathers, sufficient sloughing can occur between the edge of the cavity and the shaving material to permit air channelling adjacent to the side wall of the cavity. In another aspect dealing with mechanically produced foams, sufficient channelling may be formed interior of the shaving cream or lather. As a result, differential air pressure does not prevent an ordinary person from pulling the piston head through the entire length of the cavity.

The terms "shaving creams, lathers, foams and gels" refer to particular water-soluble products and builders formed from a fatty acid and a metal in which soap builders and air are either present or added later. "Shaving creams" useful in the invention contain large proportions of carboxyl containing substances and builders to improve lubrication characteristics such as wetting and softening agents. A shaving cream useful in the invention is a product of the Mennen Company, Morristown, N.J., 07960, called "Mennen Brushless Shaving Cream," comprising water, increased amounts of stearic acid, mineral oil, potassium stearate, glycerin, TEA stearate, isopropanolamine, myristyl alcohol and titanium dioxide. The latter are used as emollients, lubricants, perfume fixatives and wetting and pigment agents.

"Shaving lathers" increase the potassium and sodium stearate content. Denatured ethyl alcohol can also be added. Additional emollients and lubricants reduce shaving pull and add protection. A shaving lather similarly useful, is provided by the same company called "Mennen Lather Shave" and comprises of water, potassium stearate, glycerol sodium stearate, coconut oil, potassium cocoate, stearic acid, sodium cocoate, menthol, SD alcohol 40, boric acid, sodium silicate and camphor. Another medicated shaving lather useful in carrying out the invention, is provided by Noxzema Incorporated, 11050 York Road, Hunt Valley, Md, 21030-2098 called "Noxzema ® Lather Shave Cream", and comprises of water, increased amounts of stearic acid, coconut oil, potassium hydroxide, propylene glycol, sodium lauryl sulfoacetate, fragrance, and sodium metasilicate. Active ingredients include camphor, phenol (less than ½%), menthol, eucalyptus oil, clove oil, and peppermint oil.

"Shaving foams" are shaving lathers in which air has been mechanically mixed as the shaving lather is formed. No pressurized propellants are permitted, however. Data source: Soap and Detergent Association 485 Madison Avenue, New York, N.Y.

"Shaving gels" are colloids each of which having a dispersed phase combined with the continuous phase to provide a viscous shaving product. A shaving gel found to be useful in the invention is provided by the S. C. Johnson & Son, Inc., Racine, Wis., 53403, ("EDGE") and comprises of de-ionized water, palmitic acid, triethanolamine, fatty acid esters, sorbitol, cellulose polymer, FD & C blue #1 and D & D yellow #10. See U.S. Pat. No. 3,541,581 for details. There is an absence of propellants, however, when such gels are used in the present invention.

BACKGROUND

In conventional hand razors, a razor blade is mounted in the shaving head which is carried at the end of a handle normally grasped by the user's hand. Before shaving, the user conventionally applies shaving-associated materials such as lathers, creams, gels and the like, to the face or body portions to be shaved. Such materials are typically supplied in large, relatively heavy (from a traveller's point of view) multiple serving plastic and/or metallic containers. Since shaving is most often carried out in semi-closed rooms of high humidity (bathrooms and showers), such containers become slippery and difficult to manipulate when the user's hands become wet. Further, no one likes to carry excess weight on a trip. It makes little sense to carry razor, shaving foam can, and after shave of weight on the order of 22–30 ounces on an overnight or 2-day trip. The cans are bulky and difficult to store, especially where luggage space is limited. Cans and lotion bottles can leak in the luggage, especially at low pressure in airplane baggage compartments.

Many relatively unsuccessful attempts have been made to provide a handle or other means in the razor which incorporates a reservoir for a lather forming material or for a lotion. Examples of such patents include U.S. Pat. No. 4,129,942 (Denigman), having separate compartments for gels and lotions; U.S. Pat No. 4,433,483 (Lazarus), incorporating an aerosol spray can in the handle; U.S. Pat. No. 4,562,643 (Cataudalla), showing a tube squeezer in which side wall collapses to form accordion pleats; U.S. Pat No. 4,635,361 (Demars), showing a tube squeezer for shaving lotion; and U.S. Pat. No. 3,985,146 (Alback), for a handle formed of a flexible tube which itself constitutes the reservoir of the shaving cream.

These razors suffer from several drawbacks. For example: some razors do not provide enough lather, the reservoir having been overly used in prior occasions; another requires the handle to be flexible in order to squeeze out the shaving material, resulting in difficulty and danger in use when the handle becomes too flexible; still others require the handle and the shaving head to be mechanically disengaged before the shave-associated materials can be used. Also, they are complex and can become easily damaged to the point of inoperativeness if dropped; a common occurrence when handled with wet, soapy hands. Accordingly, there is a need for a simple, cheap-to-manufacture, single use, shaving system that is lightweight, disposable, portable, non-bulky, and contains in a single package all that is needed for shaving.

THE INVENTION

SUMMARY

In accordance with apparatus aspects, the present invention comprises of an imporved disposable razor assembly that includes:

(a) a handle having a first portion attached to a blade-attached shaving head suitable for use as a manually operated razor and a second, hollow portion normally grasped by the user during shaving and including a central cavity of a length dimension L but having only one exit positioned at an end surface opposite to the shaving head, the central cavity including an elongated lip at its open end to receive a reservoir of the stabilized material in an amount sufficient for a single use; and (b) a dispensing assembly adapted to drive the shaving stabilized material from the central cavity without using pressurized gas comprising a cap initially attached to the elongated lip but easily releasable therefrom by means of a tearaway tab, the cap being attached to a piston head initially at the bottom of the cavity but movable therethrough as the cap is moved away from the lip thereby releasing the shaving material.

Attachment of the cap to the cavity lip is preferably by heat wherein the outer circumference of the cap is thermally backwelded to the underside of the lip. However, other techniques could be used to provide such attachment, as by way of adhesives. In any event, the shaving material is caddied to the use site by the razor without the usual difficulties associated with transport of such toiletries.

In accordance with one embodiment, the piston head and cap are removed from the cavity and discarded before the shaving material is applied. In another embodiment, the piston head remains within the cavity during shaving although the cap and cable (after the latter tows the piston head through the cavity), are released (by a break-away release of a segment of the cable) and then are discarded.

DETAILED DESCRIPTION OF THE BEST MODE OF THE INVENTION

The following is a detailed description of preferred embodiments of the present invention and is presented by way of example only and is not intended to limit its applicable principles. Furthermore, the description is intended to clearly enable one skilled in the art to make and use the invention. It also includes various adaptations, variations, alternatives and different uses of the invention including what is presently believed to be the best mode of carrying out the invention.

Figure 1:
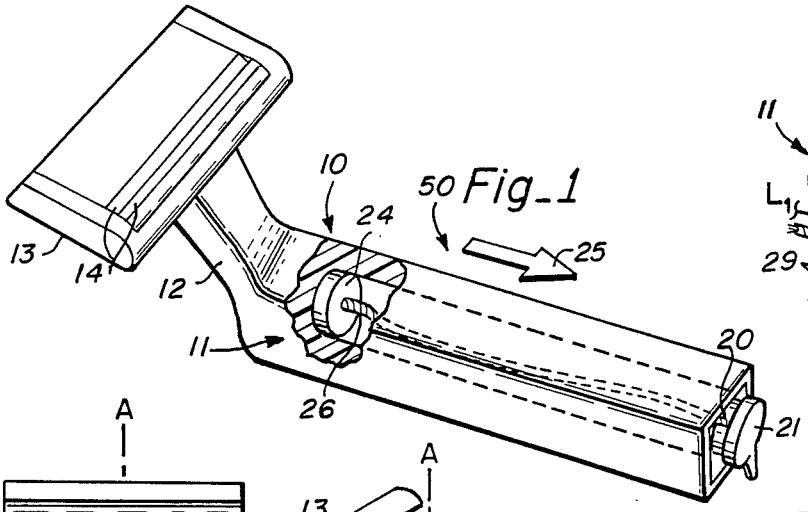
FIG. 1 is a perspective view of a razor assembly in accordance with the present invention in which a conventional disposable razor is provided with a central cavity to form a reservoir for shaving material and a dispensing assembly including a cap mechanically attached to a movable piston head cavity.
Figure 2:
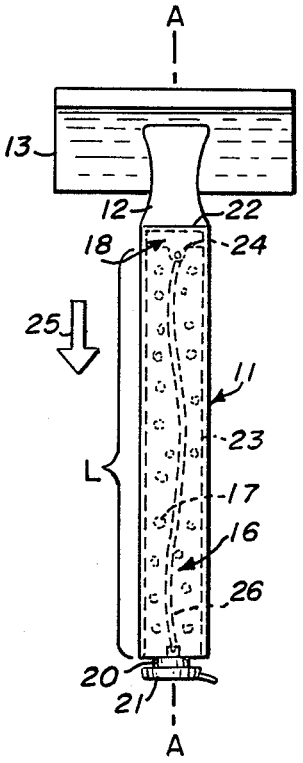
FIGS. 2 and 3 are plan and side views of the razor assembly of FIG. 1.
Figure 3:
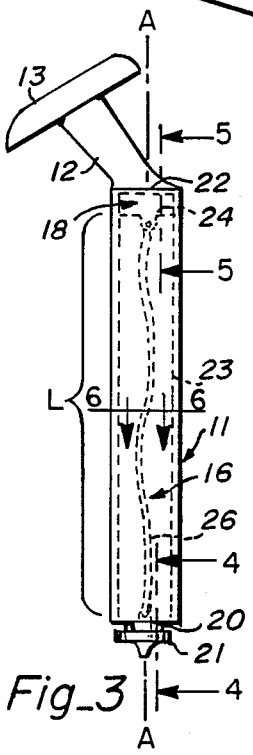

Referring to FIGS. 1–3, a disposable razor assembly 10 is shown that includes a handle 11 connected through an arcuate arm 12 to a razor head 13. The razor head 13 is of conventional construction and includes two spaced apart metallic blades 14 (see FIG. 1). Normally, the razor head 13 will be formed of injection-molded plastics material and the blades 14 will be embedded in the plastics material during the molding operation as conventional in the art. In this regard, suitable plastics materials include polyethylene, polypropylene, polystyrene and polycarbonates. Thereafter, the handle 11 can be drilled by a conventual drill bit or preformed during molding to provide a rigid cavity 16 (see FIG. 2 and 3) into which is pumped a stabilized shaving material generally at 17 along with certain elements of dispensing assembly generally indicated at 18.

In this application, the term "stabilized shaving materials" means a dispersion of soap, builders and air providing sufficient channeling along the length L of the handle 11. By the term "sufficient" it is meant that air can pass from lip 20 after cap 21 has been removed, and thence along side wall 23 to far end wall 22. In that way, as piston head 24 of dispensing assembly 18 is moved in the direction of arrow 25 via towing cable 26 attached to cap 21, the magnitude of back pressure of air acting opposite to arrow 25 is not substantial enough to hinder operations.

FIGS. 4–7 illustrate dispensing assembly 18 as well as shaving material 17 of the present invention in more detail.

Figure 4:
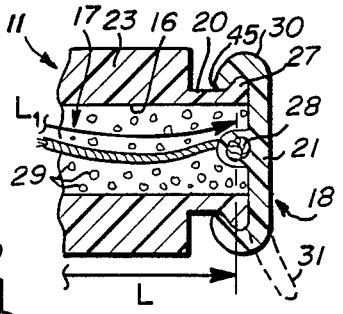
FIGS. 4, 5 and 6 are sections—greatly enlarged—taken along lines 4—4, 5—5 and 6—6 of FIG. 3 illustrating the tear-away cap, piston head cable.
Figure 7:
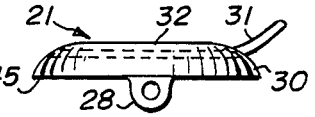

As shown in FIG. 4, the cavity 16 of the handle 11 terminates in lip 20. Interior of the side wall 23 and cap 21 is mechanically foamed shaving material 17 that includes air pockets 29 surrounding usual shaving soap, emollients and lubricants. The lip 20 is enlarged at its terminals to form bulbous portion 27. Attached to the bulbous portion 27 is the cap 21 of dispensing assembly 18. Another element of dispensing assembly 18 is towing cable 26. It connects to cap 21 via an eyelet 28. Cap 21 includes reduced wrap-around end segment 30 attached to the bulbous portion 27 of the lip 20. As best seen in FIGS. 4 and 7 tear-away tab 31 extends at an angle from the central section 32 of the cap 21.

Figure 5:
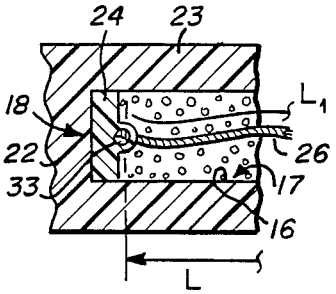

FIG. 5 shows piston head 24 of the dispensing assembly 18 in contact with end wall 22. The piston head 24 includes an eyelet 33 connected to the towing cable 26.

Figure 6:
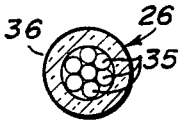

FIG. 6 illustrates towing cable 26 of dispensing assembly 18. The cable 26 comprises a series of twisted strands 35 encapsulated within waxed layer 36. The strands, 35 define a length L1 between attaching eyelets 28 or cap 21 and 33 of piston head 24 as shown in FIGS. 4 and 5, respectively. Since the cable 26 is not tautly held within the cavity 16 of FIGS. 2 and 3 (instead, the cable 26 serpentines along axis of symmetry A-A), straight line normalized distance L along the axis A-A, is less than the serpentining length L1 of the cable 26.

Figure 8:
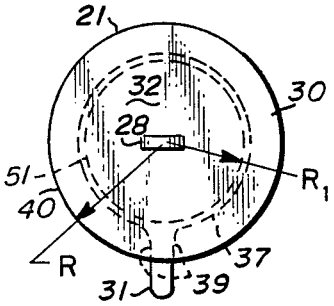
Figure 11:
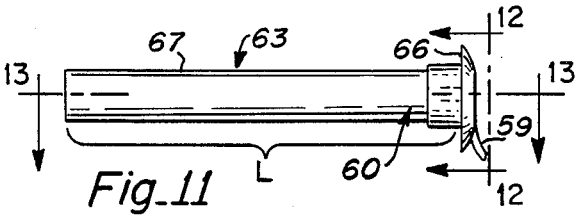
FIGS. 11 and 12 are plan and side views of an alternate embodiment of the present invention featuring a dispensing nozzle and dispensing assembly.
Figure 12:
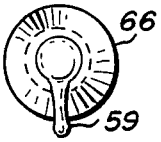

FIGS. 7 and 8 show cap 21 before attachment. Note the radius R of edge 40 is greater than $R_1$ of the detachable central section 32 that is circumscribed by band 51 tear-away tab 31. After attachment, the reduced wrap-around segment 30 is folded along circle 37 away from tab 31. Such attachment is achieved by thermal welding. Tab 31 includes transverse cuts 39 bisecting wrap around end segment 30.

Figure 9:
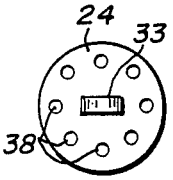
FIGS. 7–10 are details of the cap and piston head of FIGS. 4 and 5.
Figure 10:
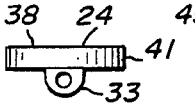

FIGS. 9 and 10 show piston head 24 unattached. As shown, the head 24 includes a set of openings 32 parallel to circumferential edge 41. After attachment, the circumferential edge 41 is placed in loose contact within the razor handle.

Further features and details will become more apparent from a brief description of construction and deployment of dispensing assembly 18. After the cavity 16 is formed within the razor handle 11, the piston head 24 is attached to cap 21 via towing cable 26, with the length of the cable 26 being greater than length L or the cavity 16. Then the head 24 is dropped into the cavity and falls to the end wall 22. Then lip 20 is fitted over an exhaust nozzle of a air-agitated loading machine (not shown), and the shaving material 17 is injected throughout the entire length of the cavity 16. After the filling of the cavity 16 has been completed, the cap 21 is placed atop lip 20. Heat and pressure are then applied to end segment 30 of the cap 21, causing reorientation of the segment 30 backward and under into surface contact with bulbous portion 27 of the lip 20. Some winnowing of material comprising the end segment 30, may occur. Back and under movement is centered near the circumferential edge 45 of the cap 21 (see FIGS. 4 and 7). Heat applied adjacent to edge 45, seals the cap 21 to the portion 27. In that way, a single use razor system generally indicated at 50 in FIG. 1 is provided. Note that the razor system 50 comprises of cavity 16 and dispensing assembly 18, wherein the cavity 16 is substantially filled with stabilized shaving material 17. The system 50 is not only light weight and portable but contains in a single package all that is needed for shaving. After the system is carried to a use site, the user applies a twisting force to tab 31 which is released from the cap 21. Release of the tab 31 is by means of band 51, (see FIG. 8) gouged out of cap 21 as the tab 31 is pulled from the cap 21.

As the cap 21 is pulled from contact with the lip 20, the towing cable 26 "loosely" disposed within cavity 16 (i.e. nontaut) is straightened relative to and become coincident with the axis of symmetry A-A, (FIGS. 2 and 3). Further movement of the cap 21 and taut cable 26, moves the piston head 24 away from end wall 22 along the cavity 16. The incremental positional change of the head 24, expels a portion of stabilized shaving material 17 from the cavity 16, and into the user's hand (not shown). Because of the stabilized nature of the shaving material 17 (viz., formulated to provide air channels along the cavity 16) air can pass into the cavity 16 thence adjacent to side wall 23 through openings 38 of the head 24 and finally into the cavity segment vacated by the head 24. In that way, the air pressure is substantially equalized in the front and back sides of the head 24 during its movement along the cavity 16. After the head 24 passes from the cavity 16, the entire dispensing assembly 18 is thrown away, say into a receptacle of any type.

ALTERNATE EMBODIMENT

FIGS. 11–15 illustrates an alternate dispensing assembly generally indicated at 60, wherein individual refill cartridges 60, each of which contains shaving material in cavity 62 of cylinder 63, may be inserted in cavity 16 of handle 11 and then discarded after use.

Figure 13:
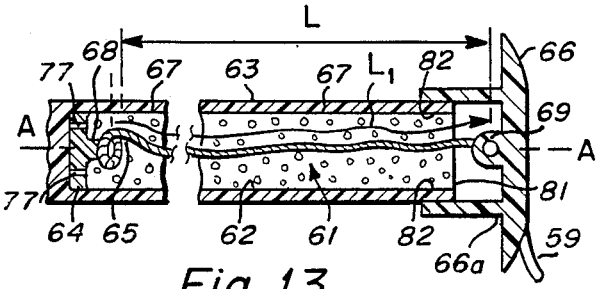
FIG. 13 is a section taken along line 13—13 of FIG. 11.

As shown in FIG. 13 shaving material 61 is inserted into cavity 62 of cylinder 63 after piston head 64 and nearly all of towing cable 65 have been loaded within the cavity 62. Thereafter funnel cap 66 (that includes tear-away tab 59) is attached to the cylinder 63, see FIG. 11.

The stabilized shaving material 61 has the same characteristics as previously discussed. Hence, a detailed discussion will be omitted at this time except to say that sufficient air channels (not shown) are provided, say between side wall 67 and a boundary of the material 61 to equalize air pressure acting on the piston head 64 during movement.

Likewise, the general shape of piston head 64 and towing cable 65 are similar to those elements as previously described except that cable 65 is attached to hub 68 of piston head 64 in break-away fashion. The straight line distance L (normalized) between hub 68 and eyelet 69 of the cap 66 (FIG. 13) is less than the length L1 of the cable 65 over the same space coextensive to the axis of symmetry A—A.

Figure 14:
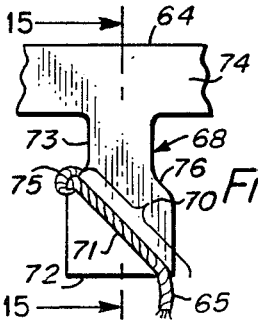
FIGS. 14 and 15 are details of the piston head illustrating the break-away feature of the towing cable.
Figure 15:
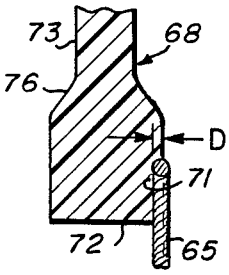

In FIGS. 14 and 15, terminal segment 70 of the cable 65 is positioned in a diagonal trench 71, see FIG. 15. The trench 71 has a depth D equal to about half of the diameter of cable 65 and starts at forward wall 72 of the hub 68. The diameter of the forward wall 72 is greater than that of neck 73 contacting center section 74 of the piston head 64 (see FIG. 14).

The segment 70 of the cable 65 can also terminate in a knot 75 in friction contact with ramp section 76. Due to the shape of knot 75 and length and radius of trench 71 vis-a-vis the diameter of the cable 65, the piston head 64 (of similar design as that shown in FIGS. 9 and 10 including openings 77) can be pulled. Movement is along cavity 62 of cylinder 63 and provides the same functions as before. Pressure is equalized on the front and back sides of the moving piston head 64. Note that during movement frictional forces acting between the trench 71, and cable segment 70 and between the knot 75 and ramp 76, are greater than forces generated by the shaving material 61 moving ahead of the piston head 64. Consequently, the piston head 64 forces the shaving material 61 rectilinearly along the side wall 67 through opening 81 and thence via segment 66*a* of cap 66 into the user's hand (not shown).

However, before the piston head 64 itself reaches opening 81, the piston head 64 becomes wedged along inwardly directed ramped section 82 relative to axis of symmetry A-A. As a result, the friction forces acting on the cable segment 70 are overcome. The cable segment 70 (and knot 75) slide from the trench 71 and the ramp 76, respectively, and thence from the relative to the side wall 67 through the opening 81 and out of the cavity 62. The opening 81 must have diameter greater than that of knot 75 so that cable 65 is completely released from the cavity 62.

Thereafter the cable 65 and cap 66 are disposed of in a receptacle (not shown). The piston head 64, however, remains in wedged, non-movable contact with ramp section 82.

It should be understood that various modifications within the scope of the invention can be made by one of ordinary skill in the art without departing from the spirit thereof. For example, a back-pressure driven valve can be used to control air flow through a radial opening in side walls 23, 67 of FIGS. 2–5, 11 and 13. In that way, the build-up of back-pressure can be modified as the shaving material is dispensed from the razor system. Thus, the invention is to be defined by the scope of the appended claims as the prior art will permit and in view of the specification if need be.

I claim:

1. A disposable razor system comprising in operative combination:

a. a handle having a first end portion and a second elongated portion having a longitudinal axis wherein:
  (i) said first end portion is adapted to carry a blade-attached shaving head member;
  (ii) said second elongated portion has a length and surface area sufficient to be grasped by the user's hand;

b. said second elongated portion having an axially aligned cavity disposed centrally therein;

c. said second elongated portion being hollow and having an inner wall defining said cavity, said inner wall having a longitudinal length axially aligned with said longitudinal axis of said second elongated portion and including:
  (i) an end wall disposed adjacent said first end portion;
  (ii) an opposite end of said second elongated portion having an opening with a lip extended therearound.
  (iii) a dispensing assembly;

(d) said dispensing assembly being axially aligned with said longitudinal axis including:
  (i) a tear-away cap sealably attached to said lip;
  (ii) a piston head having an upper surface fitted in contact with said end wall;
  (iii) a volume of stabilized shaving material sufficient for at least a single use;
  (iv) a towing cable;

(e) said towing cable being attached between said piston head and said tear-away cap whereby release and movement of said cap from said lip is transferred through said towing cable to rectilinear movement of said piston head through said cavity to drive said single use shaving material from said cavity without need for a pressurized propellant and without undue back-pressure being generated in the volume vacated by the moving piston head, said towing cable having a serpenting length L1 greater than a straight line normalized distance L between said piston head and said tear away cap; and (f) means for sufficiently equalizing the differential pressure about said moving piston head relative to said cavity such that a normal user's hand strength is sufficient to pull said piston head through said cavity and dispense said shaving material;

2. A disposable razor system as in claim 1 wherein said pressure equalization means includes:

(a) one or more openings disposed along said upper surface of said piston head; and (b) said openings being connectable through said air pockets of said shaving material.

3. The system of claim 2 in which said stabilized shaving material is selected from a group comprising shaving cream and lather, formed by reacting water, stearic acid, emollients and lubricants together, said shaving material being loadable into said cavity but capable of sloughing therein to form at least a single air channel between a boundary thereof and a side wall of said cavity.

4. The system of claim 3 in which said shaving cream and lather are foamed prior to being loaded in said cavity.

5. A disposable razor system comprising in operative combination:

(a) a handle having a first end portion and a second elongated portion having a longitudinal axis wherein:
  (i) said first end portion is adapted to carry a blade-attached shaving head member;
  (ii) said second elongated portion has a length and surface area sufficient to be grasped by the user's hand;

(b) said second elongated portion having an axially aligned cavity disposed centrally therein;

(c) said second elongated portion being hollow and having an inner wall defining said cavity, said inner wall having a longitudinal length axially aligned with said longitudinal axis of said second elongated portion and including:
  (i) an end wall disposed adjacent said first end portion;
  (ii) a cartridge receivingly disposed in and removable from said cavity;

(d) said cartridge being axially aligned with said longitudinal axis including:
  (i) a cylindrical member having a first and a second end;
  (ii) an interior end wall disposed at one end of said cylindrical member adjacent said end wall of said cavity;
  (iii) an opposite end of said second end of said cylindrical member having an opening with a lip extended therearound;
  (iv) a tear-away cap sealably attached to said lip;
  (v) a piston head having an upper surface initially fitted in said cylinder in contact with said end wall;
  (vi) a volume of stabilized shaving material sufficient for at least a single use in said cylinder;
  (vii) a towing cable in said cylinder;

(e) said towing cable being longitudinally disposed in said cylinder being attached between said piston head and said tear-away cap whereby release and movement of said cap from said lip is transferred through said towing cable to rectilinear movement of said piston head through said cartridge to drive said single use shaving material from said cartridge without need for a pressurized propellant and without undue back-pressure being generated in the volume vacated by the moving piston head, said towing cable having a serpentining length L1 greater than a straight-line normalized distance L between said piston head and said tear-away cap;

(f) means for sufficiently equalizing the differential pressure about said moving piston head relative to said cartridge such that normal user's hand strength is sufficient to pull said piston head through said cartridge and dispense said shaving material;

(g) said pressure equalization means includes:

(i) one or more openings disposed along said upper surface of said piston head.

6. The system of claim 2 in which said cartridge has a central cavity which includes a radially inward directed wedge shaped ramp section having its elevated end disposed adjacent to said lip for terminating travel of said piston head after said shaving material has been expelled from said cartridge.

7. The system of claim 6 in which said piston head includes a central hub having frictional clamping means permitting travel of said piston head through said cartridge as said cap and cable are pulled away from said lip of said cavity but releasing said cable when said piston head comes into wedged contact with said ramped section of said central cartridge.

* * * * *